United States Patent [19]

Ishikawa et al.

[11] Patent Number: 4,588,677

[45] Date of Patent: May 13, 1986

[54] METHOD FOR PROCESSING SILVER HALIDE COLOR PHOTOSENSITIVE MATERIALS

[75] Inventors: Takatoshi Ishikawa; Junya Nakajima, both of Kanagawa, Japan

[73] Assignee: Fuji Photo Film Co., Ltd., Kanagawa, Japan

[21] Appl. No.: 687,044

[22] Filed: Dec. 28, 1984

[30] Foreign Application Priority Data

Dec. 29, 1983 [JP] Japan ..... 58-248470

[51] Int. Cl.[4] ..... G03C 7/16

[52] U.S. Cl. ..... 430/387; 430/484; 430/487; 430/488; 430/490; 430/491

[58] Field of Search ..... 430/387, 442, 469, 472, 430/474, 484, 487, 490, 491

[56] References Cited

U.S. PATENT DOCUMENTS

| | | | |
|---|---|---|---|
| 4,083,723 | 4/1978 | Shimamura et al. | 430/376 |
| 4,264,716 | 4/1981 | Vincent et al. | 430/491 |
| 4,310,623 | 1/1982 | Watanabe et al. | 430/555 |
| 4,330,616 | 5/1982 | Kurematsu et al. | 430/491 |
| 4,482,626 | 11/1984 | Twist et al. | 430/491 |
| 4,483,918 | 11/1984 | Sakai et al. | 430/555 |
| 4,491,630 | 1/1985 | Ishikawa et al. | 430/387 |

*Primary Examiner*—J. Travis Brown

*Attorney, Agent, or Firm*—Sughrue, Mion, Zinn, Macpeak and Seas

[57] ABSTRACT

A method for processing a silver halide color photosensitive material which comprises processing a silver halide color photosensitive material containing at least one 4-mercapto-5-pyrazolone type magenta coupler represented by formula (I)

(I)

wherein W represents an aryl group; X represents an alkyl group, an aryl group or a heterocyclic ring group; and Y represents an acylamino group, a ureido group, or an anilino group; with a color developer containing at least one compound selected from a compound represented by formula (II)

(II)

wherein R represents a lower alkyl group, and $M_1$ and $M_2$, which can be the same or different, each represents a hydrogen atom, and an alkali metal atom, or an ammonium group; a compound represented by formula (III)

(III)

wherein $M_3$, $M_4$, $M_5$, $M_6$ and $M_7$, which can be the same or different, each represents a hydrogen atom, an alkali metal atom, or an ammonium group, and n represents an integer of 1 or 2; and an aminopolyphosphonic acid, and a phosphonocarboxylic acid in a concentration greater than $5.0\times10^{-3}$ mol/liter.

7 Claims, No Drawings

METHOD FOR PROCESSING SILVER HALIDE COLOR PHOTOSENSITIVE MATERIALS

FIELD OF THE INVENTION

This invention relates to a method for processing silver halide color photosensitive materials and more particularly to a method for processing silver halide color photosensitive materials which provides a high coloring efficiency in the color development step, shows good photographic properties without being influenced by the deviation of pH of the color developer, and can give a color image having high fastness to heat and light.

BACKGROUND OF THE INVENTION

As magenta dye image-forming couplers (hereinafter referred to as "magenta couplers"), various pyrazolone derivatives are known. However, these pyrazolone derivative couplers contained in color photosensitive materials show low coloring efficiency (low conversion rate of couplers to dyes) and so-called 4-equivalent magenta couplers having an unsubstituted coupling active position usually form dye in an amount of only about ½ mol per mol of the coupler.

For improving the coloring efficiency, so-called 2-equivalent magenta couplers having a substituent at the coupling active position of a pyrazolone type magenta coupler and are capable of splitting off the substituent in a color developing step are known as disclosed in, for example, U.S. Pat. Nos. 3,311,476, 3,419,391, 3,617,291, 3,926,631, etc. Also, as magenta couplers each having a substituent bonded to the coupling active position of a magenta coupler through a sulfur atom, couplers having a thiocyano group are described in U.S. Pat. No. 3,214,437; couplers having an acylthio group or a thioacylthio group are described in U.S. Pat. No. 4,032,346; couplers having an arylthio group or a heterocyclic thio group are described in U.S. Pat. Nos. 3,227,554 and 3,701,783, and in Japanese Patent Publication No. 34044/78; and couplers having an alkylthio group are described in West German Patent Application (OLS) No. 2,944,601.

However, it has now been clarified by the inventor's detailed investigations that in the magenta couplers described in the foregoing U.S. Pat. Nos. 3,227,554 and 3,701,783, the couplers having an arylthio group at the coupling active position are insufficient in light fastness in this age of rapid progressing improvement of the properties of color photosensitive materials when the couplers are used in the color photosensitive materials and color images are formed.

Also, it has been clarified that when the magenta couplers releasing an arylthio group as described in Japanese Patent Publication No. 34044/78 are used for color photosensitive materials, the color images formed are insufficient in light fastness.

Furthermore, the magenta couplers releasing an arylthio group as described in Japanese Patent Application (OPI) No. 35858/82 (the term "OPI" as used herein refers to a "published unexamined Japanese patent application") are excellent couplers in the point of overcoming the above-described disadvantages of the conventional couplers. However, the above-described conventional magenta couplers releasing an arylthio group have a disadvantage of reducing the coloring property when the color photographic materials containing the magenta couplers are processed by a color developer containing an alkaline earth metal salt such as a salt of calcium, magnesium, etc. This becomes a fatal demerit when the color developer is prepared using water containing a large amount of an alkaline earth metal salt, i.e., hard water. A color developer usually contains various chelating agents for covering these alkaline earth metal atoms in an amount of $1\times10^{-3}$ to $4\times10^{-3}$ mol/liter and the amount is sufficient for covering the alkaline earth metal atoms. However, when color photosensitive materials containing the magenta couplers having an arylthio group as a releasable group are processed by the color developer, the coloring property is reduced even by the above-described addition amount of the chelating agent, whereby a sufficient coloring property cannot be obtained.

SUMMARY OF THE INVENTION

A first object of this invention is, therefore, to provide a method for processing silver halide color photosensitive materials containing 4-mercapto-5-pyrazolone 2-equivalent magenta couplers without causing changes in desirable photographic properties obtained by an ordinary color process.

A second object of this invention is to provide a method for processing color photosensitive materials capable of providing color images having high fastness.

A third object of this invention is to provide a method for processing color photosensitive materials which provides less deviation of the photographic properties due to deviations in the pH of the color developer.

A fourth object of this invention is to provide a method for processing silver halide color photosensitive materials containing reduced amounts of couplers and silver halide.

It has now been discovered that the above-described objects of this invention can be attained by a method for processing silver halide color photosensitive materials which comprises processing a silver halide color photosensitive material containing at least one 4-mercapto-5-pyrazolone type magenta coupler represented by formula (I) below, with a color developer containing at least one of a compound represented by formula (II) below, a compound represented by formula (III) below, an aminopolyphosphonic acid, and a phosphonocarboxylic acid in a concentration greater than $5.0\times10^{-3}$ mol/liter.

The 4-mercapto-5-pyrazolone type magenta coupler is represented by

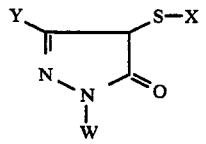

(I)

wherein W represents an aryl group; X represents an alkyl group, an aryl group, or a heterocyclic ring group; and Y represents an acylamino group, a ureido group, or an anilino group.

The compound of formula (II) is represented by

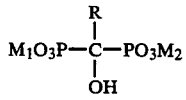

(II)

wherein R represents a lower alkyl group, and $M_1$ and $M_2$, which can be the same or different, each represents a hydrogen atom, an alkali metal atom, or an ammonium group.

The compound of formula (III) is represented by

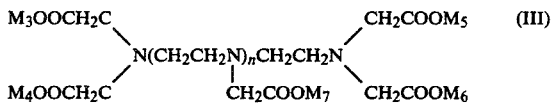

(III)

wherein $M_3$, $M_4$, $M_5$, $M_6$, and $M_7$, which may be the same or different, each represents a hydrogen atom, an alkali metal atom, or an ammonium group, and n represents 1 or 2.

DETAILED DESCRIPTION OF THE INVENTION

It was utterly unexpected that the problem of providing low coloring property in the case of ordinary processing a silver halide color photosensitive material containing a magenta coupler having an arylthio group as a releasable group can be solved by processing the color photosensitive material using a color developer containing at least one compound as described above in a large amount of more than $5\times10^{-3}$ mol/liter.

The compounds represented by formula (I) are now explained in more detail.

The aryl group shown by W in general formula (I) preferably is a phenyl group and a naphthyl group, each of which is substituted by at least one halogen atom, alkyl group, alkoxy group, alkoxycarbonyl group or cyano group.

The alkyl group shown by X includes a straight or branched chain alkyl group having from 1 to 42 carbon atoms, an alkenyl group, a cycloalkyl group, an aralkyl group, and an alkynyl group, and these groups can each be substituted by a hydrogen atom, a hydroxy group, a mercapto group, a cyano group, a nitro group, a carboxy group, an aryl group, an alkoxy group, an aryloxy group, a heterocyclic oxy group, an acyloxy group, an alkoxycarbonyloxy group, an aryloxycarbonyloxy group, a silyloxy group, a carbamoyloxy group, a phosphoric acid oxy group, an acylamino group, a sulfonamido group, an alkoxycarbonylamino group, an aryloxycarbonylamino group, a diacylamino group, a carbamoylamino group, a sulfamoylamino group, an aromatic heterocyclic ring group (e.g., a pyrazolyl group, an imidazolyl group, a triazolyl group, etc.), a non-aromatic heterocyclic ring group (e.g., a piperidino group, a morpholino group, etc.), an imido group, a monooxo nitrogen-heterocyclic ring group (e.g., pyridone, saccharin, etc.), an acyl group, an alkoxycarbonyl group, an aryloxycarbonyl group, a carbamoyl group, a sulfamoyl group, a silyl group, an alkylthio group, an arylthio group, a heterocyclic thio group, a sulfonyl group, an alkenyl group, an anilino group, etc.

The aryl group shown by X includes a phenyl group having from 6 to 46 carbon atoms and a naphthyl group and these groups can each be substituted by an alkyl group or a substituent as described above in regard to the foregoing alkyl group.

Furthermore, the heterocyclic ring group shown by X includes a 5-membered or 6-membered heterocyclic ring group including one or more nitrogen atoms, oxygen atoms, or sulfur atoms, or combinations thereof, and may be condensed to the benzene ring. Typical examples of the heterocyclic ring skeleton are as follows.

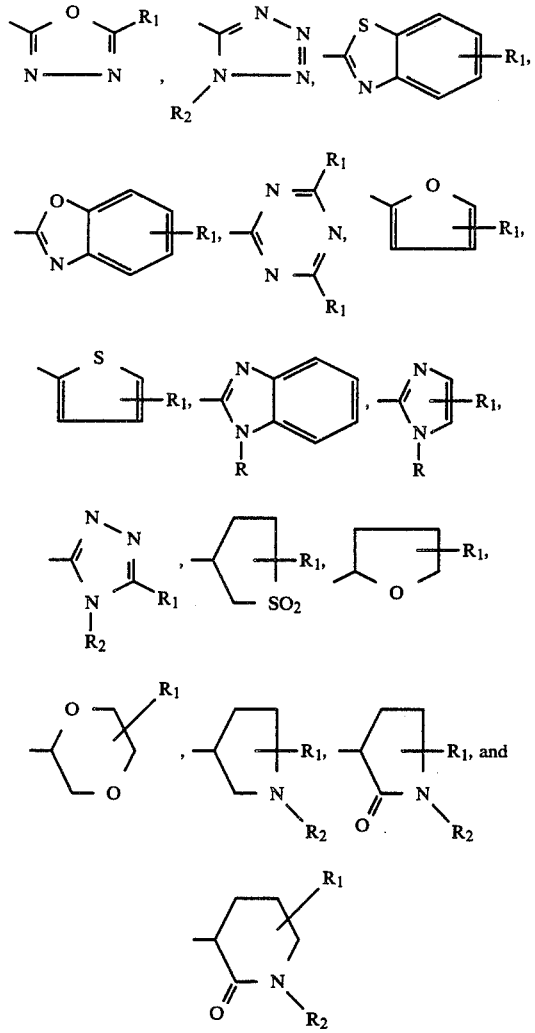

wherein $R_1$ represents a hydrogen atom, an alkyl group (the same alkyl group as shown by X of formula (I)), or the same groups as the substituents described above as the substituents for the alkyl group shown by X of formula (I); and $R_2$ represents a hydrogen atom, an alkyl group, an aryl group, an acyl group, an alkylsulfonyl group, or an arylsulfonyl group.

The acylamino group represented by Y includes an alkanamido group having from 1 to 42 carbon atoms or a benzamido group having 6 to 46 carbon atoms; the ureido group shown by Y includes an alkylureido group having 1 to 42 carbon atoms and a phenylureido group having from 6 to 46 carbon atoms; and the anilino group shown by Y includes a phenylamino group having from 6 to 46 carbon atoms. The foregoing alkyl moiety may have the same substituents as described above as the substituents for the alkyl group shown by X of formula (I), and the phenyl moiety may have an alkyl group or the same substituents as the substituents described above as the substituents for alkyl group shown by X of formula (I).

Particularly preferred couplers of the 4-mercapto-5-pyrazolone type couplers represented by formula (I) are the couplers represented by formulae (IV) and (V).

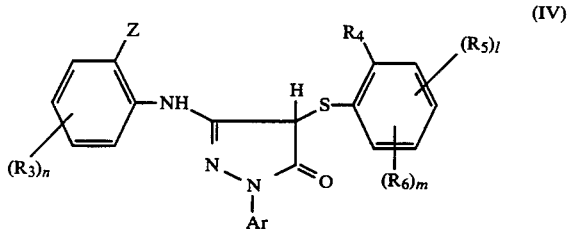

(IV)

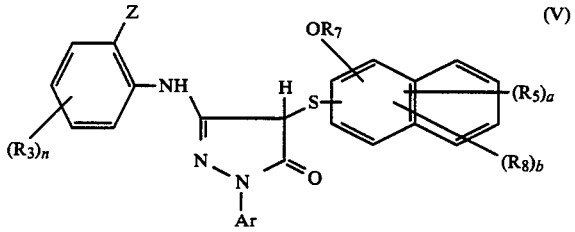

(V)

In the above formulae (IV) and (V), Ar represents a phenyl group substituted by at least one halogen atom, alkyl group, alkoxy group, alkoxycarbonyl group, or cyano group; Z represents a halogen atom or an alkoxy group; $R_3$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkyloxycarbonylamino group, a ureido group, an acyl group, a nitro group, or a carboxy group; $R_4$ represents a halogen atom, a hydroxy group, an amino group, an alkyl group, an alkoxy group, an aryloxy group, or an aryl group; $R_5$ represents a hydrogen atom, an amino group, an acylamino group, a ureido group, an alkoxycarbonylamino group, an imido group, a sulfonamido group, a sulfamoylamino group, a nitro group, an alkoxycarbonyl group, a carbamoyl group, an acyl group, a cyano group, an alkylthio group; $R_6$ represents a hydrogen atom, a halogen atom, a hydroxy group, an alkyl group, an alkoxy group, or an aryl group; at least one of said $R_4$ and $R_6$ representing an alkoxy group; m represents an integer of 1 to 3; n represents an integer of 1 to 4; and l represents an integer of 1 to 3. Also, $R_7$ represents an alkyl group or an aryl group; $R_8$ represents a hydrogen atom, a halogen atom, an alkyl group, an alkoxy group, an aryloxy group or an aryl group; and a and b each represents an integer of 1 to 5.

Ar in the above formular (IV) and (V) is explained in more detail as follows. Ar represents a substituted phenyl group and the substituent thereof includes a halogen atom (e.g., a chlorine atom, a bromine atom, a fluorine atom, etc.), an alkyl group having 1 to 22 carbon atoms (e.g., a methyl group, an ethyl group, a tetradecyl group, a t-butyl group, etc.), an alkoxy group (e.g., a methoxy group, an ethoxy group, an octyloxy group, a dodecyloxy group, etc.), an alkoxycarbonyl group having 2 to 23 carbon atoms (e.g., a methoxycarbonyl group, an ethoxycarbonyl group, a tetradecyloxycarbonyl group, etc.), and a cyano group.

Z in formulae (IV) and (V) is explained in more detail as follows. That is, Z represents a halogen atom (e.g., a chlorine atom, a bromine atom, a fluorine atom, etc.) or an alkoxy group having from 1 to 22 carbon atoms (e.g., a methoxy group, an octyloxy group, a dodecyloxy group, etc.).

Furthermore, $R_3$ in above formula (IV) and (V) is explained in more detail. That is, $R_3$ preferably represents a hydrogen atom, a halogen atom (e.g., a chlorine atom, a bromine atom, a fluorine atom, etc.), an alkyl group (e.g., a methyl group, a t-butyl group, a 2-methanesulfonamidoethyl group, a t-butanesulfonylethyl group, a tetradecyl group, etc.), an alkoxy group (e.g., a methoxy group, an ethoxy group, a 2-ethylhexyloxy group, a tetradecyloxy group, etc.), an acylamino group (e.g., an acetamido group, a benzamido group, a butanamido group, a tetradecanamido group, an α-(2,4-di-tert-amylphenoxy)acetamido group, an α-(2,4-di-tert-amylphenoxy)butyramido group, an α-(3pentadecylphenoxy)hexanamido group, an α-(4-hydroxy-3-tert-butylphenoxy)tetradecanamido group, a 2-oxopyrrolidine-1-yl group, a 2-oxo-5-tetradecylpyrrolidine-1-yl group, an N-methyl-tetradecanamido group, an α-(3-methanesulfonamidophenoxy)tetradecanamido group, etc.), a sulfonamido group (e.g., a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (e.g., an N-methylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group, an N-methyl-N-tetradecylsulfamoyl group, etc.), a carbamoyl group (e.g., an N-methylcarbamoyl group, an N-octadecylcarbamoyl group, an N-[4-(2,4-ditert-amylphenoxy)butyl]-carbamoyl group, an N-methyl-N-tetradecylcarbamoyl group, etc.), a diacylamino group (e.g., an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (e.g., a methoxycarbonyl group, a tetradecyloxycarbonyl group, a benzyloxycarbonyl group, etc.), an alkoxysulfonyl group (e.g., a methoxysulfonyl group, an octyloxysulfonyl group, a tetradecyloxysulfonyl group, etc.), an aryloxysulfonyl group (e.g., a phenoxysulfonyl group, a 2,4-di-tertamylphenoxysulfonyl group, etc.), an alkanesulfonyl group (e.g., a methanesulfonyl group, an octanesulfonyl group, a 2-ethylhexanesulfonyl group, a hexadecanesulfonyl group, etc.), an arylsulfonyl group (e.g., a benzenesulfonyl group, a 4-nonylbenzenesulfonyl group, etc.), an alkylthio group (e.g., an ethylthio group, a hexylthio group, a benzylthio group, a tetradecylthio group, a 2-(2,4-di-tert-amylphenoxy)ethylthio group, etc.), an arylthio group (e.g., a phenylthio group, a p-tolylthio group, etc.), an alkyloxycarbonylamino group (e.g., an ethyloxycarbonylamino group, a benzyloxycarbonylamino group, a hexadecyloxycarbonylamino group, etc.), a ureido group (e.g., an N-methylureido group, an N-phenylureido group, an N,N-dimethylureido group, an N-methyl-N-dodecylureido group, an N-hexadecylureido group, an N,N-dioctadecylureido group, etc.), an acyl group (e.g., an acetyl group, a benzoyl group, an octadecanoyl group, a p-dodecanamidobenzoyl group, etc.), a nitro group, or a carboxy group. In the aforesaid groups, the alkyl moiety has from 1 to 42 carbon atoms and the aryl moiety has from 6 to 46 carbon atoms.

Also, $R_4$ in formula (IV) is explained in more detail. That is, $R_4$ represents a halogen atom (e.g., a chlorine atom, a bromine atom, etc.), a hydroxy group, an amino group (i.e., substituted or unsubstituted amino groups including an N-alkylamino group, an N,N-dialkylamino group, an N-anilino group, an N-alkyl-N-arylamino group and a heterocyclic amino group, such as, for example, an N-butylamino group, an N,N-dibutylamino group, an N,N-dihexylamino group, an N-piperidino group, an N,N-bis(2-dodecyloxyethyl)amino group, an N-cyclohexylamino group, an N-phenylamino group, an N,N-bis(2-hexasulfonylethyl)amino group, etc.), an alkyl group (i.e., straight or brahcned chain alkyl groups including an aralkyl group, an alkenyl group, a cycloalkyl group, and a cycloalkenyl group, such as, for example, a methyl group, a butyl group, an octyl group, a dodecyloxy group, a benzyl group, a cyclopentyl group, a 2-methanesulfonylethyl group, a 3-phenoxypropyl group, etc.), an alkoxy group (e.g., a methoxy group, a butoxy group, a benzyloxy group, a 2-ethylhexyloxy group, a dodecyloxy group, a 2-methanesulfonylethyl group, a 2-butanesulfonylethyl group, an isopropyloxy group, a 2-chloroethyl group, a 3-(2,4-di-tert-amylphenoxy)propyl group, a 2-(N-methylcarbamoyl)ethoxy group, a cyclopentyloxy group, a 2-ethoxytetradecyloxy group, a 4,4,4,3,3,2,2-heptafluorobutyloxy group, a 3-(N-butylcarbamoyl)-propyloxy group, a 3-(N,N-dimethylcarbamoyl)-propyloxy group, a 4-methanesulfonylbutoxy group, a 2-ethanesulfonamidoethyl group, etc.), an aryloxy group (e.g., a phenoxy group, a 2,4-dichlorophenoxy group, etc.), or an aryl group (i.e., substituted or unsubstituted phenyl groups having 6 to 38 carbon atoms and α- or β-naphthyl groups, such as a 4-chlorophenyl group, a 4-t-butylphenyl group, a methanesulfonamidophenyl group, a 2,4-dimethylphenyl group, etc.).

$R_5$ in formulae (IV) and (V) is a hydrogen atom, an amino group (i.e., substituted or unsubstituted amino groups including an N-alkylamino group, an N,N-dialkylamino group, an N-anilino group, an N-alkyl-N-arylamino group, and a heterocyclic amino group, such as, for example, an N-butylamino group, an N,N-diethylamino group, an N-[2-(2,4-di-tert-amylphenoxy)ethyl]amino group, an N,N-dibutylamino group, an N-piperidino group, an N,N-bis(2-dodecyloxyethyl)amino group, an N-cyclohexylamino group, an N,N-dihexylamino group, an N-phenylamino group, a 2,4-di-tert-amylphenylamino group, an N-(2-chloro-5-tetradecanamidophenyl)amino group, an N-methyl-N-phenylamino group, an N-(2-pyridyl)amino group, etc.), an acylamino group (e.g., an acetamido group, a benzamido group, a tetradecanamido group, a (2,4-di-tertamylphenoxy)acetamido group, a 2-chlorobenzamido group, a 3-pentadecylbenzamido group, a 2-(2-methanesulfonamidophenoxy)dodecanamido group, a 2-(2-chlorophenoxy)tetradecanamido group, etc.), a ureido group (e.g., a methylureido group, a phenylureido group, a 4-cyanophenylureido group, etc.), an alkoxycarbonylamino group (e.g., a methoxycarbonylamino group, a dodecyloxycarbonylamino group, a 2-ethylhexyloxycarbonylamino group, etc.), an imido group (e.g., an N-succinimido group, an N-phthalimido group, an N-hydantoinyl group, a 5,5-dimethyl-2,4-dioxooxazole-3-yl group, an N-(3-octadecenyl)succinimido group, etc.), a sulfonamido group (e.g., a methanesulfonamido group, an octanesulfonamido group, a benzenesulfonamido group, a 4-chlorobenzenesulfonamido group, a 4-dodecylbenzenesulfonamido group, an N-methyl-N-benzenesulfonamido group, a 4-dodecyloxybenzenesulfonamido group, a hexadodecanesulfonamido group, etc.), a sulfamoylamino group (e.g., an N-octylsulfamoylamino group, an N,N-dipropylsulfamoylamino group, an N-ethyl-N-phenylsulfamoylamino group, an N-(4-butyloxy)sulfamoylamino group, etc.), a nitro group, an alkoxycarbonyl group (e.g., a methoxycarbonyl group, a butoxycarbonyl group, a dodecyloxycarbonyl group, a benzyloxycarbonyl group, etc.), a carbamoyl group (e.g., an N-octylcarbamoyl group, an N,N-dibutylcarbamoyl group, an N-phenylcarbamoyl group, an N-[3-(2,4-di-tert-amylphenoxy)propyl]carbamoyl group, etc.), an acyl group (e.g., an acetyl group, a benzoyl group, a hexanoyl group, a 2-ethylhexanoyl group, a 2-chlorobenzyl group, etc.), a cyano group, or an alkylthio group (e.g., a dodecylthio group, a 2-ethylhexylthio group, a benzylthio group, a 2-oxocyclohexylthio group, a 2-(ethyltetradecanoate)thio group, a 2-(dodecylhexanoate)thio group, a 3-phenoxypropylthio group, a 2-dodecanesulfonylethylthio group, etc.).

$R_6$ in formula (IV) represents a hydrogen atom, a hydroxy group, or an alkyl group, alkoxy group or aryl group as described in regard to $R_4$. At least one of said $R_4$ and $R_6$ is, however, an alkoxy group.

Also, $R_7$ is the alkyl group or the aryl group as described above in regard to $R_4$, and $R_8$ is the halogen atom, alkyl group, alkoxy group, or aryl group as described in regard to $R_4$.

Then, specific examples of the magenta couplers shown by the above formula (I) for use in this invention are illustrated below, but the magenta couplers for use in this invention are not limited thereto.

M-1

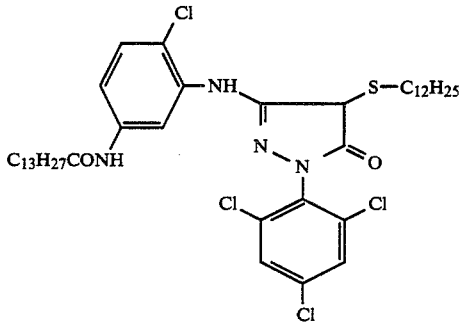

M-2

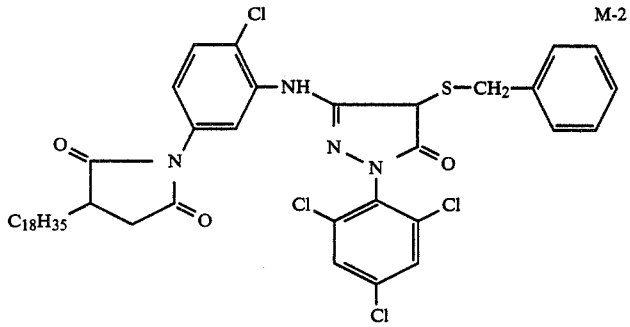

-continued
M-3
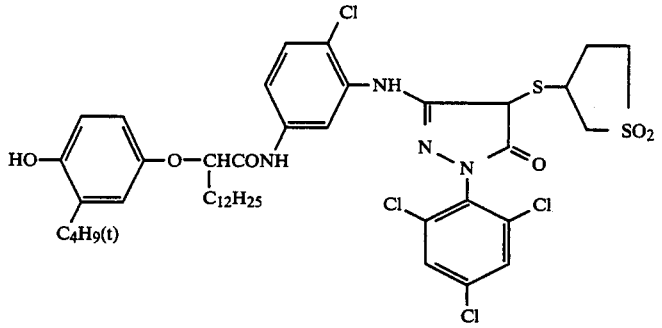
M-4
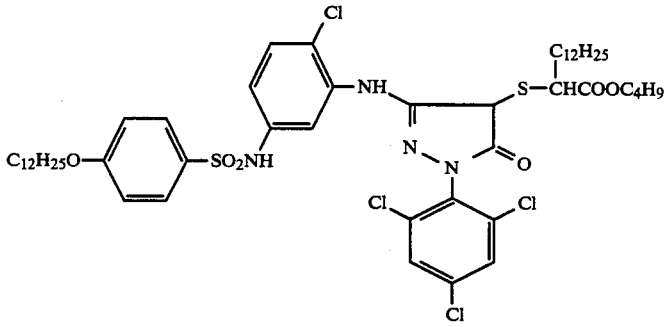
M-5
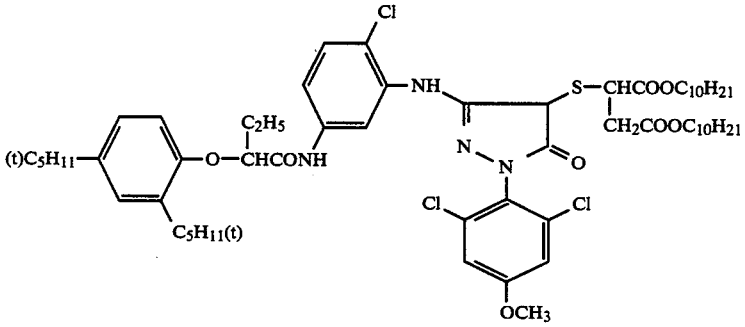
M-6
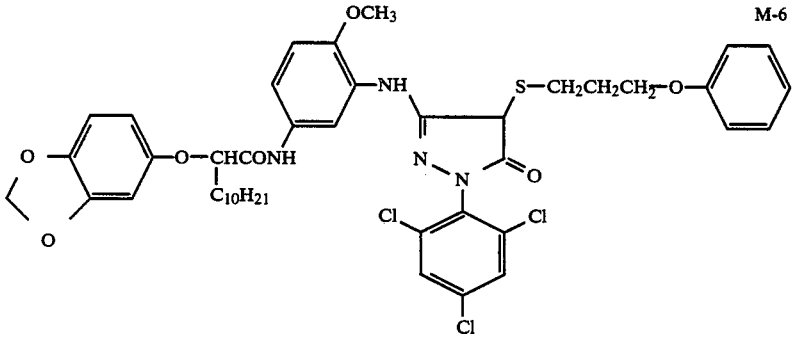
M-7
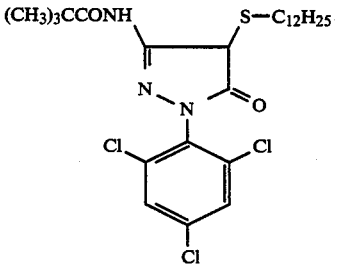
M-8
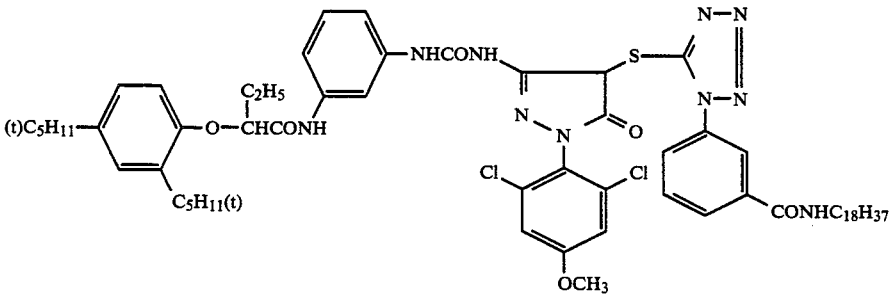

-continued
M-9
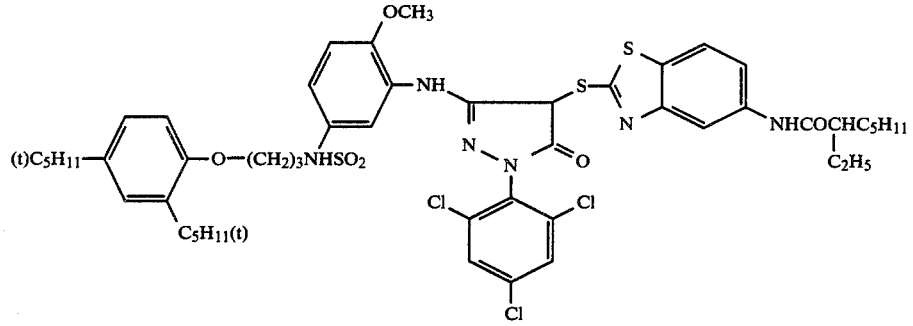
M-10
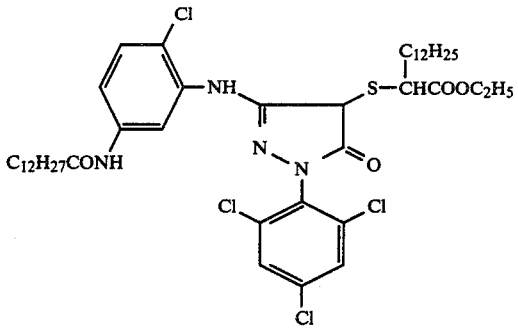
M-11
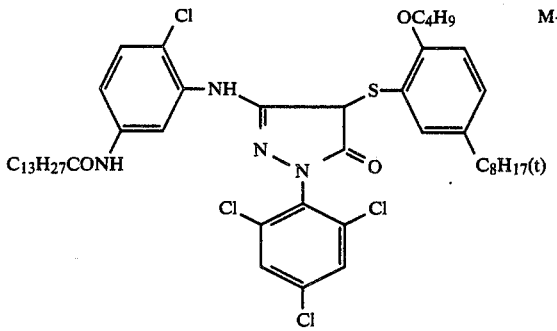
M-12
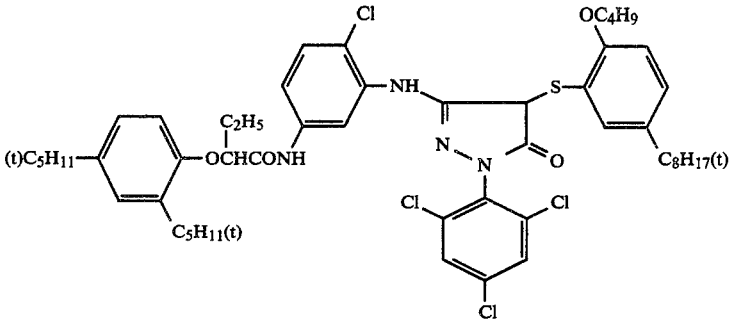
M-13
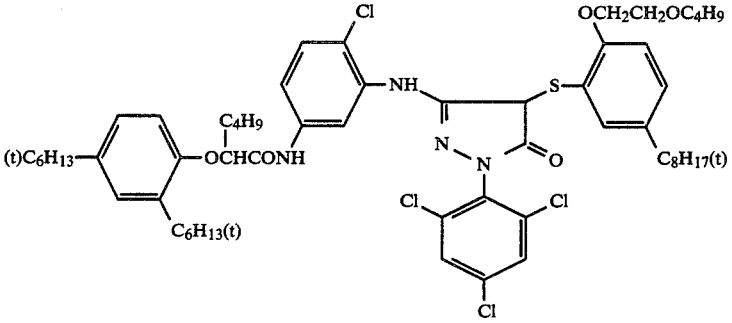
M-14
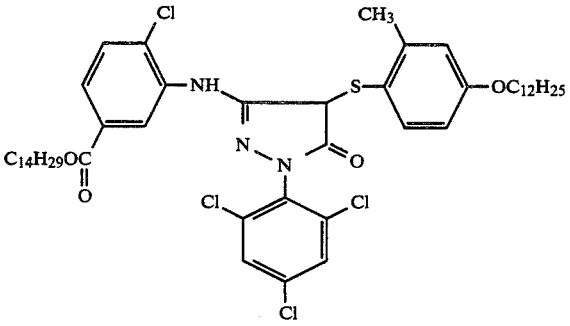

-continued
M-15
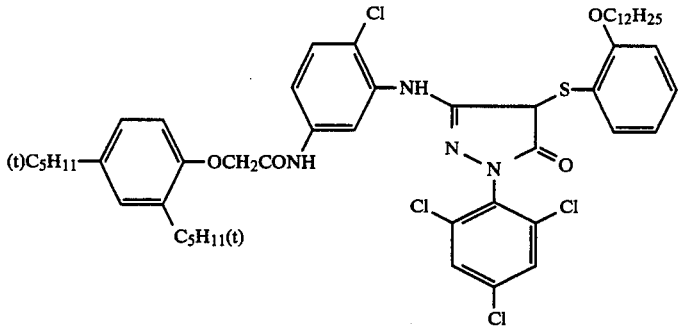
M-16
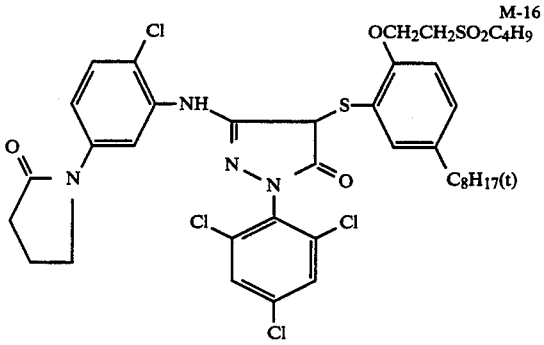
M-17
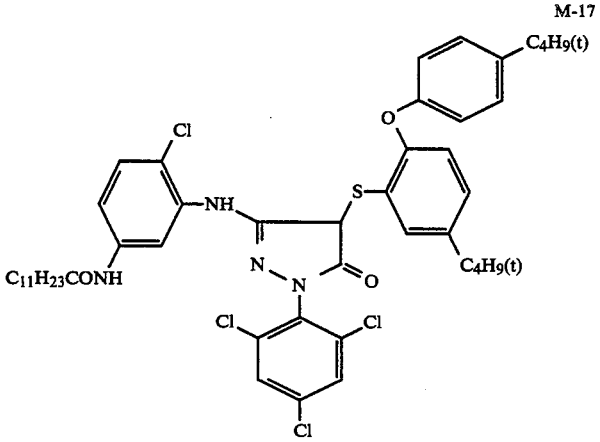
M-18
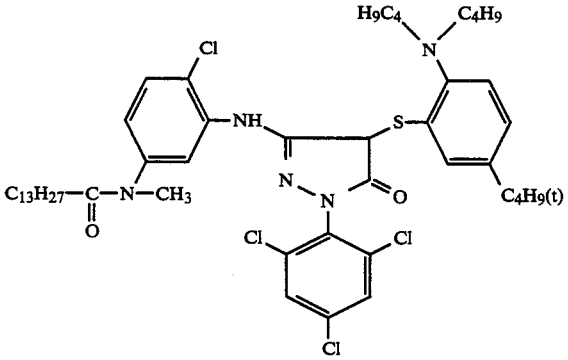
M-19
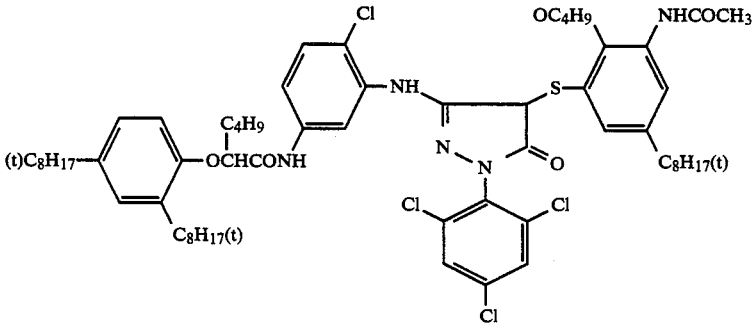

-continued
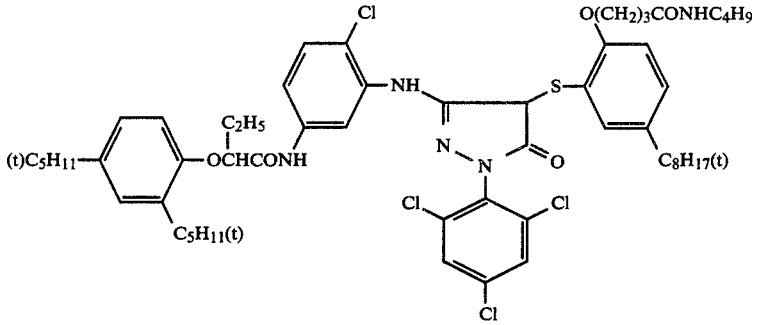
M-20
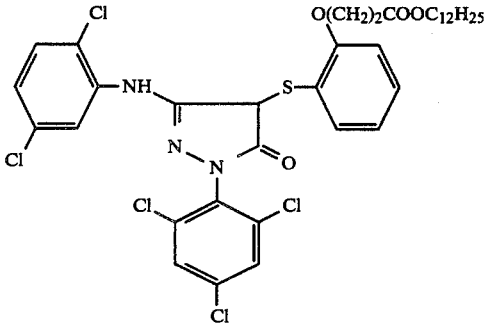
M-21
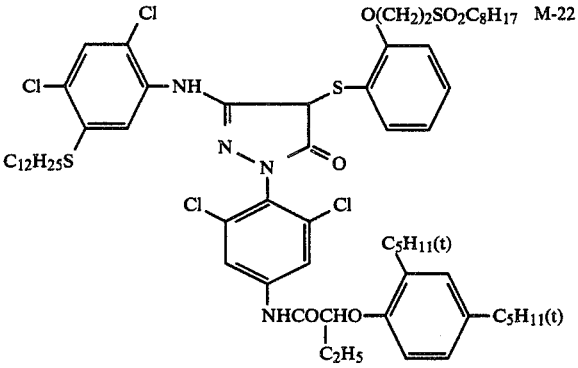
M-22
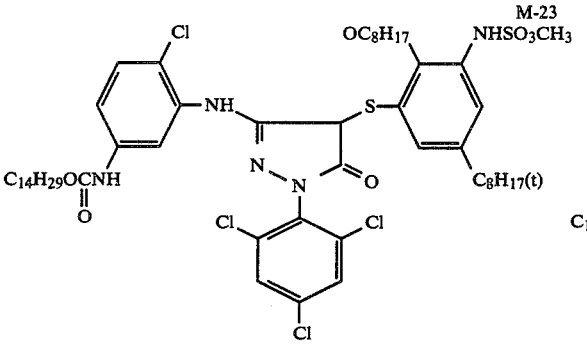
M-23
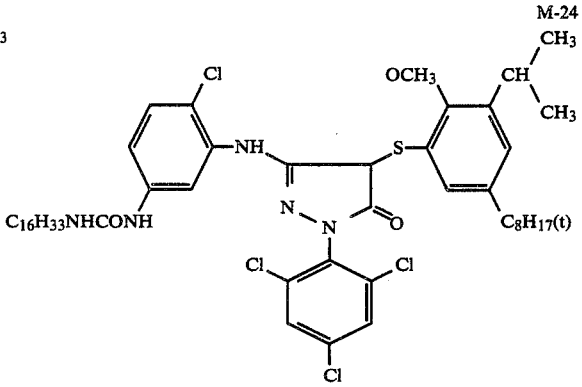
M-24
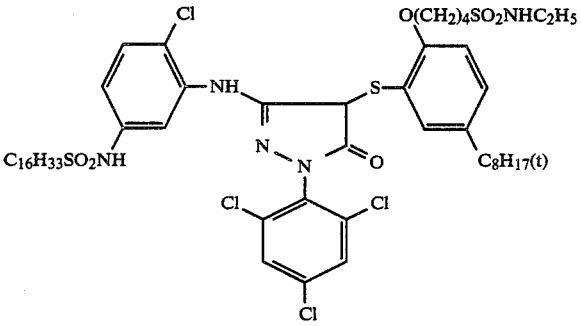
M-25

-continued
M-26
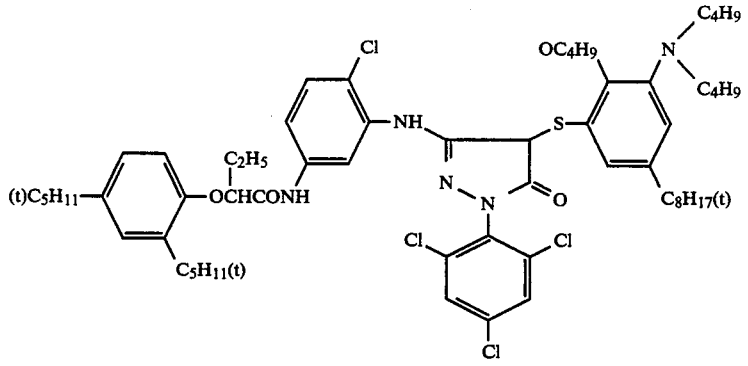
M-27
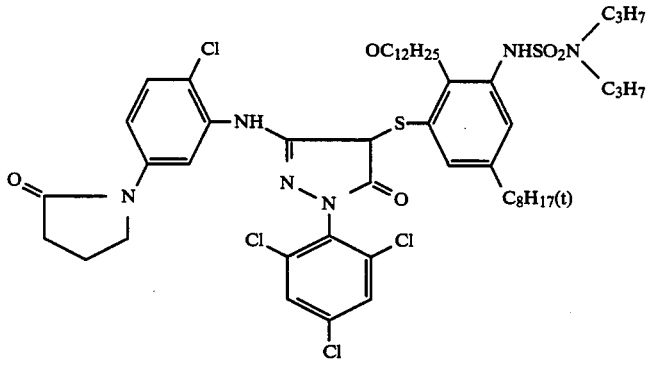
M-28
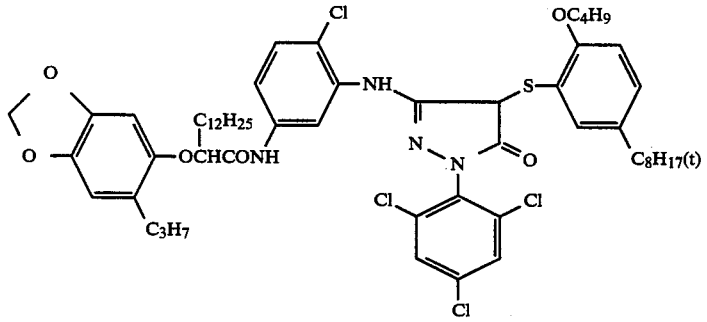
M-29
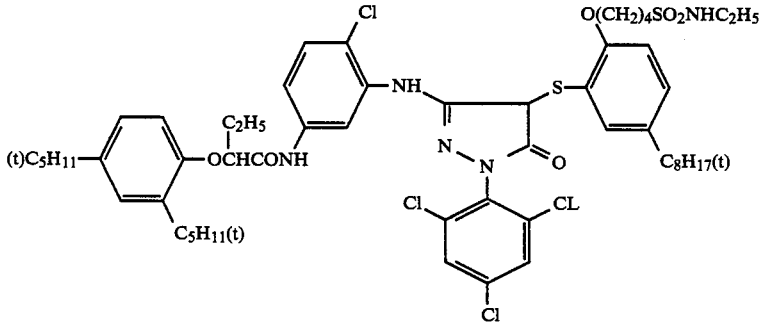

-continued
M-30
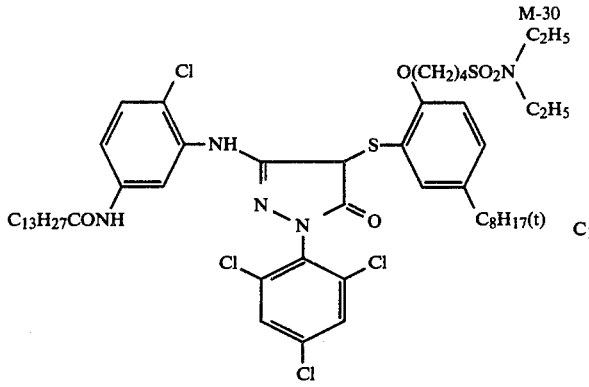
M-31
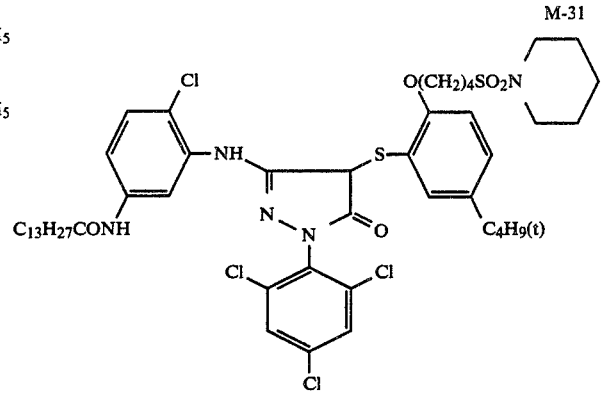
M-32
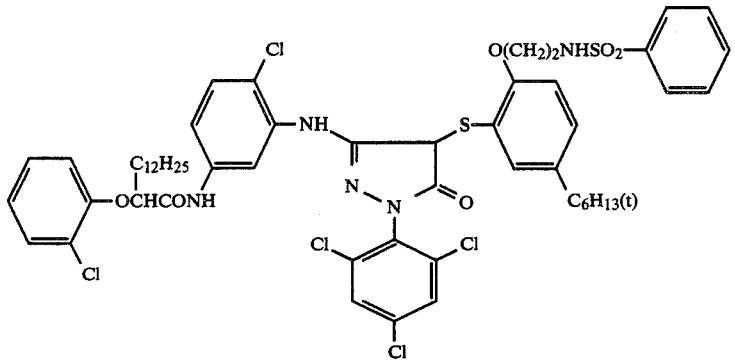
M-33
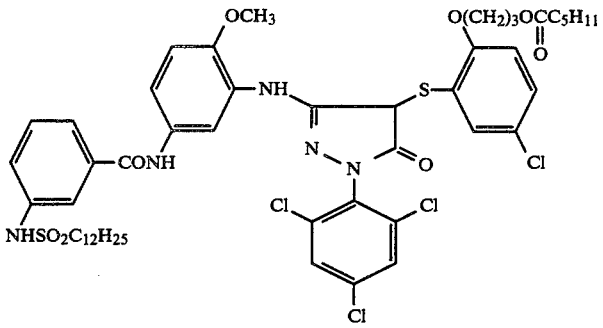
M-34
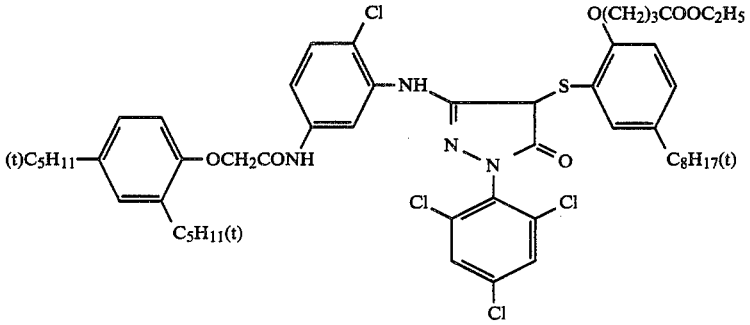

-continued

M-35

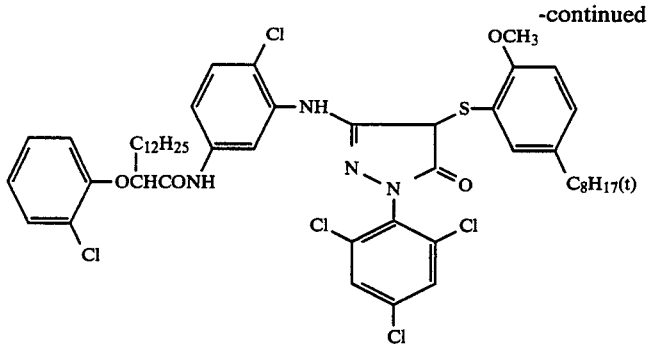

M-36

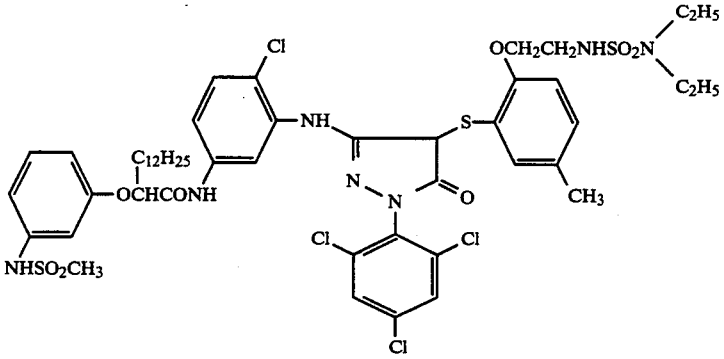

M-37

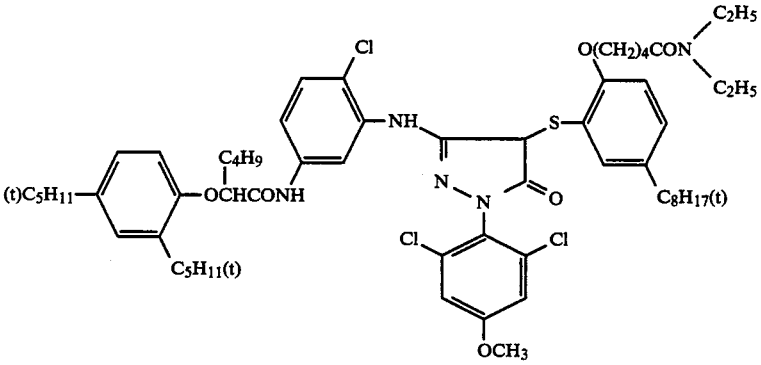

The magenta couplers for use in this invention can be prepared based on the methods described, for example, in Japanese Patent Publication No. 34044/78, Japanese Patent Application (OPI) No. 62454/80, U.S. Pat. No. 3,701,783, etc.

The coupler is generally incorporated in a silver halide emulsion layer in an amount of from $2\times10^{-3}$ mol to $5\times10^{-1}$ mol, and more preferably from $1\times10^{-2}$ mol to $5\times10^{-1}$ mol per mol of silver in the emulsion layer.

Two or more kinds of the foregoing couplers may be incorporated in one silver halide emulsion layer for meeting the characters required for the color photosensitive materials, or a same coupler may be incorporated in two or more silver halide emulsion layers.

The couplers can be introduced into silver halide emulsion layers by the method described, for example, in U.S. Pat. No. 2,322,027. For example, the coupler is dissolved in a high boiling organic solvent such as a phthalic acid alkyl ester (e.g., dibutyl phthalate, diphenyl phosphate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamido (e.g., diethyllaurylamido, etc.), a fatty acid ester (e.g., dibutoxyethyl succinate, diethyl azerate, etc.), etc., or a low boiling organic solvent having a boiling point of about 30° C. to 150° C., such as a lower alkyl acetate (e.g., ethyl acetate, butyl acetate, etc.), ethyl propionate, sec-butyl alcohol, methyl isobutyl ketone, β-ethoxyethyl acetate, methyl cellosolve acetate, etc., and the organic solvent solution of the coupler is dispersed in an aqueous hydrophilic colloid solution. If desired, the foregoing high boiling organic solvent and low boiling organic solvent may be used as a mixture thereof.

Specific examples of the compound shown by formula (II) which is incorporated in a color developer in the method of this invention are shown below, although the compounds for use in this invention are not limited thereto.

II-1

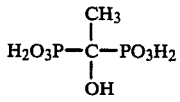

-continued

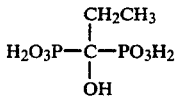

II-2

Also, specific examples of the compound shown by formula (III) above described are shown below, although the compounds are not limited thereto.

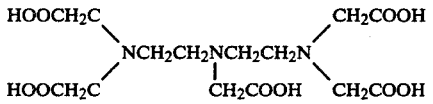

III-1

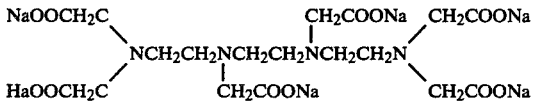

III-2

Specific examples of the aminopolyphosphonic acid which can be used in the color developer in the method of this invention are shown below, although the compounds for use in this invention are not limited thereto.

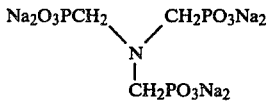

IV-1

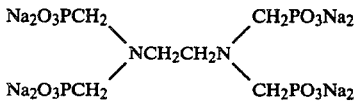

IV-2

Also, specific examples of the phosphonocarboxylic acid which is incorporated in the color developer in the method of this invention are shown below, although the compounds for use in this invention are not limited thereto.

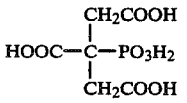

V-1

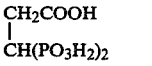

V-2

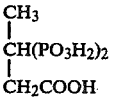

V-3

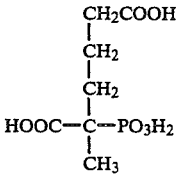

V-4

-continued

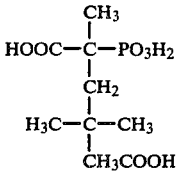

V-5

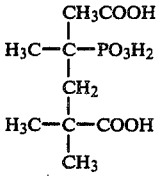

V-6

In the foregoing specific examples, the carboxylic acid and the phosphonic acid may form salts with an alkali metal atom or an ammonium atom.

The compounds illustrated in the aforesaid examples are mostly commercially available compounds. Also, such compounds can be prepared by the methods described, for example, in U.S. Pat. No. 3,214,454, West German patent application (OLS) No. 2,015,068, Japanese patent application (OPI) Nos. 82725/78 and 84920/78.

The addition amount of these compounds is generally larger than $5.0\times10^{-3}$ mol, and is preferably from $6.0\times10^{-3}$ to $30\times10^{-3}$ mol, per liter of a color developer.

Also, these compounds may be used as a mixture of two or more kinds and in the case of using the mixture thereof, the total amount of these compounds is generally larger than $5.0\times10^{-3}$ mol/liter, and preferably from $6.0\times10^{-3}$ to $30\times10^{-3}$ mol/liter.

In the above described specific compounds, Compounds II-1, III-1, IV-2 and V-1 are particularly preferred in this invention.

The color developer for use in this invention contains an aromatic primary amino color developing agent. Preferred color developing agent is the p-phenylenediamine derivatives as illustrated below, but the color developing agents for use in this invention are not limited thereto.

D-1 N,N-Diethyl-p-phenylenediamine
D-2 2-Amine-5-diethylaminotoluene
D-3 2-Amino-5-(N-ethyl-N-laurylamino)toluene
D-4 4-[N-Ethyl-N-(B-hydroxyethyl)amino]aniline
D-5 2-Methyl-4-[N-ethyl-N-(β-hydroxyethyl-)amino]aniline
D-6 N-Ethyl-N-(β-methanesulfonamidoethyl)-3-methyl-4-aminoaniline
D-7 N-(2-Amino-5-diethylaminophenylethyl)methanesulfonamide
D-8 N,N-Dimethyl-p-phenylenediamine
D-9 4-Amino-3-methyl-N-ethyl-N-methoxyethylaniline
D-10 4-Amino-3-methyl-N-ethyl-N-α-ethoxyethylaniline D-11 4-Amino-3-methyl-N-ethyl-N-α-butoxyethylaniline Also, these p-phenylenediamine derivatives may be in the forms of salts such as sulfates, hydrochlorides, sulfites, p-toluenesulfonates, etc.

The above-described p-phenylenediamine derivatives are described, for example, in U.S. Pat. Nos. 2,193,015, 2,552,241, 2,566,271, 2,592,364, 3,656,950, 3,698,525, etc. The amount of the aromatic primary amino developing agent is generally from about 0.1 g to about 20 g, and preferably from about 0.5 g to about 10 g,per liter of color developer.

It is preferred that the color develoepr for use in this invention further contains a hydroxylamine, as is ordinarily used.

The hydroxylamine may be used as the form of a free amine in the color developer, but is generally used in the form of a water-soluble acid salt. Examples of the salt are sulfates, oxalates, hydrochlorides, phosphates, carbonates, acetates, etc. The hydroxylamine may be substituted or unsubstituted and further the nitrogen atom of the hydroxylamine may be substituted by a nitrogen atom. Preferred hydroxylamines for use in this invention are shown by the formula

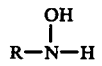

wherein R represents a hydrogen atom or a substituted or unsubstituted alkyl group having 1 to 3 carbon atoms, preferably a substituted alkyl group having 1 to 3 carbon atoms.

The compounds of the above formula may be in the form of water-soluble acid salts as described above. In the particularly preferred hydroxylamine shown by the above formula, R is a hydrogen atom. The addition amount of the compound is preferably 0.1 to 20 g, more preferably 1 to 10 g, per liter of the color developer.

Specific examples of the hydroxylamine for use in this invention are shown below:

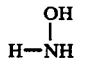
H-1

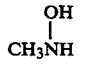
H-2

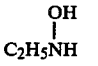
H-3

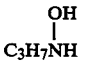
H-4

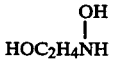
H-5

The pH of the color developer for use in this invention is preferably from 9 to 12, and more preferably from 9 to 11.0, and the color developer may further contain other known developer components.

For example, the color developer for use in this invention further contains an alkali agent or a pH buffer such as sodium hydroxide, potassium hydroxide, sodium carbonate, potassium carbonate, sodium tertiary phosphate, potassium tertiary phosphate, potassium metaphosphate, borax, etc., solely or as a combination thereof. Furthermore, for imparting a buffer function to the color developer, facilitating the preparation of the developer, or increasing the ionic strength of the developer, various salts such as disodium hydrogenphosphate, dipotassium hydrogenphosphate, sodium dihydrogenphosphate, potassium dihydrogenphosphate, sodium hydrogencarbonate, potassium hydrogencarbonate, boric acid, an alkali nitrate, an alkali sulfate, etc.

Furthermore, the color developer for use in this invention can contain, if desired, an optional development accelerator. Examples of such development accelerator are the various pyridinium compounds and other cationic compounds described, for example, in U.S. Pat. No. 2,648,604, Japanese Patent Publication No. 9503/69, and U.S. Pat. No. 3,171,247; cationic dyes such as phenosafranine, etc.; neutral salts such as thallium nitrate, potassium nitrate, etc.; polyethylene glycol and the derivatives thereof described in Japanese Patent Publication No. 9304/69, U.S. Patents 2,533,990, 2,531,832, 2,950,970 and 2,577,127; nonionic surface active agents such as polythioethers; organic solvents as described in Japanese Patent Publication No. 9509/69 and Belgian Pat. No. 682,862; and organic amines such as ethanolamine, ethylenediamine, diethanolamine, etc. Other examples of the development accelerators for use in this invention are described in L. F. A. Mason, *Photographic Processing Chemistry,* pages 40–43 (Focal Press, London, 1966). Other examples of useful accelerators are benzyl alcohol and phenylethyl alcohol described in U.S. Pat. No. 2,515,147; and pyridine, hydrazine, and amines described in *Journal of The Society of Photographic Science and Technology of Japan,* Vol. 14, page 74 (1952). Also, the thioether compounds described in U.S. Pat. No. 3,201,242 may be also used as the accelerator in this invention. In the foregoing compounds, ethylenediamine, benzyl alcohol, and the thioether compounds are preferred.

Also, the color developer for use in this invention may ordinarily contain a preservative such as sodium sulfite, potassium sulfite, potassium hydrogensulfite, sodium hydrogensulfite, etc.

Furthermore, the color developer for use in this invention may contain, if desired, an antifoggant. As the antifoggant for use in this invention, there are alkali metal halides such as potassium bromide, sodium bromide, potassium iodide, etc., and organic antifoggant. Examples of the organic antifoggant are nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, hydroxyazaindolizine, etc.; mercapto-substituted heterocyclic compounds such as 1-phenyl-5-mercaptotetrazole, 2-mercaptobenzimidazole, 2-mercaptobenzothiazole, etc.; and mercapto-substituted aromatic compounds such as salicylic acid, etc. In these compounds, the nitrogen-containing heterocyclic compounds are particularly preferred. These antifoggants may be used in such a manner that they are dissolved from color photosensitive materials in a color developer during processing and accumulated in the color developer.

When the method of this invention is applied to a reversal color photographic process, the color developer may further contain a competing coupler, a fogging agent and a compensation developing agent.

As the competing couplers, citrazinic acid, J-acid (2-amino-5-naphthol-7-sulfonic acid) and H-acid (1-amino-8-naphthol-3,6-disulfonic acid) are useful. Specific examples of competing couplers are described, for example, in Japanese Patent Publication Nos. 9504/69, 9506/69 and 9507/69, U.S. Patents 2,742,832, 3,520,690, 3,560,212 and 3,645,737, etc.

As a fogging agent, an alkali metal borohydride, amineborane, ethylenediamine, etc., can be used. Other examples of the fogging agents are described in Japanese Patent Publication No. 38816/72.

As the compensation developing agent, p-aminophenol, N-benzyl-p-aminophenol, 1-phenyl-3-pyrazolidone, etc., can be used. For example, the compounds described in Japanese Patent Nos. 41475/70 and 19037/71 are useful as the compensation developing agents in this invention.

The method of this invention can be applied to a developing system wherein coloring agents are contained in color photographic materials (e.g., U.S. Pat. Nos. 2,376,679 2,322,027, 2,801,171, etc.) as well as to a developing system wherein coloring agents exist in color developers (e.g., U.S. Pat. Nos. 2,525,718, 2,592,243, 2,590,970, etc.).

Thus, the processing method of this invention can be applied for processing various silver halide color photographic materials such as color photographic negative films, color photographic papers, color photographic positive films, color photographic reversal films, etc.

In the method of this invention, the steps for processing image-exposed color photographic negative films, color photographic positive films, color photographic papers, etc., are fundamentally composed of (1) Color development→bleach→wash→fix→wash→stabilization→drying.

(2) Color development→blix→wash→stabilization→drying.

(3) Color development→stop-fix→blix→wash→stabilization→drying.

In these cases, a pre-bath and a hardening bath may be employed before the color development and also the wash and stabilization after bleach may be omitted, as the case may be.

On the other hand, the steps for processing color photographic reversal films are fundamentally composed of (4) Black-and-white development→stop→wash→fogging→color development→stop→wash→bleach→wash→fix→wash→stabilization→drying.

(5) Black-and-white development→wash→fogging→color development→wash→acceleration→bleach→fix→wash→stabilization→drying.

In steps (4) and (5), a pre-bath, a prehardening bath, a neutralization bath, etc., may be employed and further a blix bath may be used. Also, the wash steps after stop, stabilization, and color development may be omitted or further the wash step and the acceleration bath after bleach may be omitted.

The fogging bath contains a fogging agent such as t-butylamineborane, sodium borohydride, tinaminopolycarboxylic acid complex salt, etc. Also, by adding the fogging agent to the color developer, the fogging bath may be omitted. Also, re-exposure may be employed in place of the fogging bath.

In the photographic processing method of this invention, the steps (1) to (5) are useful but the method of this invention is not limited thereto.

The color development steps are usually performed at from 20° to 60° C. and for from 30 sec to 10 min.

The processing method of this invention can be applied for any color photographic materials wherein the color development steps are required, such as color photographic negative films, color photographic papers, color photographic positive films, color photographic reversal films, etc.

The silver halide photographic emulsions which are used in this invention can be prepared by the methods described, for example, in P. Glafkides, *Chimie et Physique Photographique* (published by Paul Montel, 1967), G. F. Duffin, *Photographic Emulsion Chemistry* (published by The Focal Press, 1966), and V. L. Zelikman et al., *Making and Coating Photographic Emulsion* (published by The Focal Press, 1964). That is, the emulsions can be prepared by an acid method, a neutralization method, an ammonia method, etc. Also, as the system for reacting a soluble silver salt and a soluble halide, a one side mixing method, a simultaneous mixing method, or a combination thereof can be used.

A so-called back mixing method wherein silver halide grains are formed in the presence of excessive silver ions can be used. As one system of the simultaneous mixing method, a so-called controlled double jet method, that is, a method wherein pAg in the liquid phase is maintained at a constant value during the formation of the silver halide in the liquid.

For the silver halide photographic emulsion layers of color photosensitive materials which are processed by the method of this invention, silver bromide, silver iodobromide, silver iodochlorobromide, silver chloroiodide, or silver chloride can be used as the silver halide.

During the formation of silver halide grains or physical ripening of silver halide grains, a cadmium salt, a zinc salt, a lead salt, a thallium salt, an iridium salt or a complex salt thereof, a rhodium salt or a complex salt thereof, an iron salt or a complex salt thereof, etc., may coexist in the system.

The silver halide emulsions are usually chemically sensitized. For the chemical sensitization, the method described, for example, in *Die Grundlagen der Photographischen Prozesse mit Silberhalogeniden,* pages 675–734, edited by H. Frieser (Akademische Verlagsgesellschaft, 1968) can be used.

That is, a sulfur sensitization method using active gelatin or compounds containing sulfur capable of reacting with silver (e.g., thiosulfates, thioureas, mercapto compounds, rhodanines, etc.); a reduction sensitization method using reducing materials (e.g., stannous salts, amines, hydrazine derivatives, formamidinesulfinic acid, silane compounds, etc.); or a noble metal sensitization method using noble metal compounds (e.g., gold complex salts and complex salts of metals belonging to Group VIII of the Periodic Table, such as Pt, Ir, Pd, etc.) can be used solely or as a combination thereof.

The silver halide photographic emulsions for use in this invention can contain various compounds for preventing the formation of fog during the production, storage or processing of photosensitive materials or stabilizing the photographic properties of photosensitive materials. As such antifoggants or stabilizers, there are azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole, etc.), etc.; mercaptopyrimidines; mercaptotriazines; thioketo compounds such as oxazolinethione, etc.; azaindenes such as triazaindenes, tetraazaindenes (in particular, 4-hydroxy-substituted (1,3,3a,7)tetraazaindenes), pentaazaindenes, etc.; benzenethiosulfonic acid; benzenesulfinic acid; benzenesulfonic acid amide, etc.

The silver halide photographic emulsions for use in this invention may be spectrally sensitized by methine dyes, etc. The sensitizing dyes for use include cyanine dyes, merocyanine dyes, complex cyazine dyes, complex merocyanine dyes, holopolar cyanine dyes, hemicyanine dyes, styryl dyes, and hemioxonol dyes. Particularly useful dyes are cyanine dyes, merocyanine dyes and complex merocyanine dyes. For these dyes, nuclei usually utilized for cyanine dyes as basic heterocyclic nuclei can be used.

Examples of the useful sensitizing dyes are described, for example, in German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

The silver halide emulsions may further contain dyes having no spectral sensitizing action by themselves or materials which do not substantially absorb visible light, but which show supersensitization together with sensitizing dyes. Examples of these materials include aminostilbene compounds substituted by a nitrogen-containing heterocyclic ring group (e.g., U.S. Pat. Nos. 2,933,390 and 3,635,721), aromatic organic acid-formaldehyde condensation products (e.g., U.S. Pat. No. 3,743,510), cadmium salts, azaindene compounds, etc. The combinations of the compounds described in U.S. Pat. Nos. 3,615,613, 3,615,641, 3,617,295 and 3,635,721 are particularly useful for such purpose.

As the binder or protective colloid for silver halide photographic emulsions, gelatin is advantageously used, but other hydrophilic colloids can also be used.

Examples of such hydrophilic colloids are gelatin derivatives, graft polymers of gelatin and other polymers; proteins such as albumin, casein, etc.; cellulose derivatives such as hydroxyethyl cellulose, carboxymethyl cellulose, cellulose sulfuric acid esters, etc.; sugar derivatives such as sodium alginate, starch derivatives, etc.; synthetic hydrophilic polymers or copolymers such as polyvinyl alcohol, polyvinyl alcohol partial acetal, poly-N-vinyl pyrrolidone, polyacrylic acid, polymethacrylic acid, polyacrylamide, polyvinylimidazole, polyvinyl pyrazole, etc.

Examples of the typical synthetic hydrophilic polymers are described, for example, in West German Patent Application (OLS) No. 2,313,708, U.S. Pat. Nos. 3,620,751 and 3,879,205, Japanese Patent Publication No. 7561/68, etc.

This invention can be applied to a multilayer multicolor photographic material having at least two photographic emulsion layers each having a different spectral sensitization on a support. A multilayer natural color photographic material usually has at least one red-sensitive emulsion layer, at least one green-sensitive emulsion layer and at least one blue-sensitive emulsion layer on a support. The coating order of these layers can be defined as occasion demands. A red-sensitive emulsion layer usually contains a cyan-forming coupler, a green-sensitive emulsion layer usually contains a magenta-forming coupler, and a blue-sensitive emulsion layer usually contains a yellow-forming coupler, but other combinations may be employed, if desired.

The photosensitive materials which are processed in this invention may contain water-soluble dyes in hydrophilic colloid layers as filter dyes or for irradiation prevention and other various purposes. Such water-soluble dyes include oxonol dyes, hemioxonol dyes, styryl dyes, merocyanine dyes, cyanine dyes, and azo dyes. Among these dyes, oxonol dyes, hemioxonol dyes, and merocyanine dyes are useful.

At the practice of this invention, the following fading preventing agents or dye image stabilizing agents can be used solely or as a combination thereof. That is, examples of these materials include the hydroquinone derivatives as described, for example, in U.S. Pat. Nos. 2,360,290, 2,418,613, 2,675,314, 2,701,197, 2,704,713, 2,728,659, 2,732,300, 2,735,765, 2,710,801 and 2,816,028, British Pat. No. 1,363,921, etc.; the gallic acid derivatives described, for example, in U.S. Pat. Nos. 3,457,079, 3,069,262, etc.; p-alkoxyphenols as described, for example, in U.S. Pat. Nos. 2,735,765 and 3,698,909, Japanese Patent Publication Nos. 20977/74, 6623/77; p-oxyphenol derivatives as described, for example, in U.S. Pat. Nos. 3,432,300, 3,573,050, 3,574,627 and 3,764,337, Japanese Patent Application (OPI) Nos. 35633/77, 147434/77, 152225/77, etc.; and bisphenols as described, for example, in U.S. Pat. No. 3,700,455, etc.

The photosensitive materials for use in this invention may further contain ultraviolet absorbents in the hydrophilic colloid layers. Examples of ultraviolet absorbents are aryl group-substituted benzotriazole compounds (described, for example, in U.S. Pat. No. 3,533,794), 4-thiazolidone compounds (described, for example, in U.S. Pat. Nos. 3,314,794 and 3,352,681), benzophenone compounds (described, for example, in Japanese Patent Application (OPI) No. 2784/71), cinnamic acid ester compounds (described, for example, in U.S. Pat. Nos. 3,705,805 and 3,707,375), butadiene compounds (described, for example, in U.S. Pat. No. 4,045,229), and benzoxazole compounds (described, for example, in U.S. Pat. No. 3,700,455). Furthermore, the compounds described in U.S. Pat. No. 3,499,762 and Japanese Patent Application (OPI) No. 48535/79 can be used. Still further, ultraviolet absorptive couplers (e.g., $\alpha$-naphtholic cyan dye-forming couplers) and ultraviolet absorptive polymers may be used. These ultraviolet absorbents may be mordanted in specific layers of the photographic materials.

The photosensitive materials for use in this invention may further contain whitening agents such as stilbene series, triazine series, oxazole series, or cumarine series in the silver halide photographic emulsion layers or other hydrophilic colloid layers. These whitening agents may be water-soluble or water-insoluble, whitening agents may be used as the form of dispersions. Specific examples of brightening agents are described, for example, in U.S. Pat. Nos. 2,632,701, 3,269,840 and 3,359,102, British Pat. Nos. 852,075, 1,319,763, etc.

The photographic materials for use in this invention may further contain dye-forming couplers, i.e., the compounds capable of coloring by the oxidative coupling reaction with an aromatic primary amino color developing agent (e.g., a phenylenediamine derivative, an aminophenol derivative, etc.) in the color development process in the silver halide photographic emulsion layers. Examples of such dye-forming couplers are 5-pyrazolone couplers, pyrazolone benzimidazole couplers, cyanoacetyl cumarone couplers, open chained acylacetonitrile couplers, etc., for magenta-forming couplers; acylacetamide couplers (e.g., benzoylacetanilides, pivaloylacetanilides, etc.), etc., for yellow-forming couplers; and naphthol couplers and phenol couplers for cyan couplers.

It is desirable that these couplers are nondiffusible couplers having a hydrophobic group called a "ballast group" in the molecule, or polymerized couplers. The couplers may be 4-equivalent or 2-equivalent with respect to silver ions.

Also, these couplers may be colored couplers having a color correction effect or couplers releasing a development inhibitor or a development accelerator with the progress of development (i.e., so-called DIR couplers or DAR couplers).

Furthermore, the silver halide emulsion layers may contain non-coloring DIR coupling compounds which give colorless reaction products by a coupling reaction thereof and release a development inhibitor in place of the DIR couplers.

The silver halide emulsion layers may also contain compounds releasing a development inhibitor with the progress of development in place of the DIR couplers.

It is necessary that the silver halide emulsion layers contain the compounds shown by formula (I) described hereinbefore as magenta couplers, other magenta couplers may be used together with the magenta couplers of formula (I). Examples of such magenta couplers which may be used together with the couplers of formula (I) are described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, West German Pat. No. 1,810,464, West German Patent Application (OLS) Nos. 2,408,665, 2,417,945 2,418,959 and 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78.

As the yellow couplers, benzoylacetanilide series compounds and pivaloylacetanilide series compounds are advantageously used. Specific examples of the yellow couplers for use in this invention are described in U.S. Pat. Nos. 2,875,057, 3,265,506, 3,408,194, 3,551,155, 3,582,322, 3,725,072 and 3,891,445, West German Pat. No. 1,547,868, West German Patent Application (OLS) Nos. 2,219,917, 2,261,361 and 2,414,006, British Pat. No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, 115219/77, etc.

As the cyan couplers, phenolic compounds and naphtholic compounds can be used. Specific examples of such cyan couplers are described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, West German Patent Application (OLS) Nos. 2,414,830 and 2,454,329, Japanese Patent Application (OPI) Nos. 59838/73, 26034/76, 5055/73, 146828/76, 69624/77, 90932/77 155538/82, 204545/82, etc.

Colored couplers which can be used in this invention are described, for example, in U.S. Pat. Nos. 3,476,560, 2,521,908 and 3,034,892, Japanese Patent Publication Nos. 2016/69, 22335/63, 11304/67 and 32461/69 Japanese Patent Application (OPI) Nos. 26034/76 and 42121/77, West German Patent Application (OLS) No. 2,418,959.

DIR couplers which can be used in this invention are described, for example, in U.S. Pat. Nos. 3,227,554, 3,617,291, 3,701,783, 3,790,384 and 3,632,345, West German Patent Application (OLS) Nos. 2,414,006, 2,454,301 and 2,454,329, British Patent 953,454, Japanese Patent Application (OPI) Nos. 69524/77 and 122335/74, and Japanese Patent Publication No. 16141/76.

Examples of compounds releasing a development inhibitor with the progress of development, which can be used in place of the foregoing DIR couplers, are described in U.S. Pat. Nos. 3,297,445 and 3,379,529, West German Patent Application (OLS) No. 2,417,914, and Japanese Patent Application (OPI) Nos. 15271/77 and 9116/78.

The foregoing couplers may be contained in the same emulsion layer as a combination of two or more kinds, and same coupler may be contained in two or more emulsion layers.

Each of these couplers is incorporated in the silver halide emulsion layer in an amount of from $2\times10^{-3}$ to $5\times10^{-1}$ mol, and preferably from $1\times10^{-2}$ to $5\times10^{-1}$ mol, per mol of silver.

The following examples are intended to illustrate the invention, but not to limit it in any way.

EXAMPLE 1

Each sample of multilayer silver halide color photographic materials was prepared by coating the following first layer (the lowermost layer) through seventh layer (the uppermost layer) on a paper support having polyethylene coatings, on both surfaces thereof, said polyethylene coating containing a white pigment ($TiO_2$, etc.) and a bluish dye (ultramarine, etc.) at the emulsion layer side.

First Layer: Blue-Sensitive Emulsion Layer

An emulsion layer containing 0.35 g/m$^2$ (calculated as silver) of silver chlorobromide (80 mol % silver bromide), 1.54 g/m$^2$ of gelatin, 0.50 g/m$^2$ of a yellow coupler*6, and 0.50 g/m$^2$ of a coupler solvent*2.

Second Layer: Interlayer

A layer containing 1.10 g/m$^2$ of gelatin, 0.20 g/m$^2$ of a color mixing preventing agent*4, and 0.10 g/m$^2$ of a solvent*2 for color mixing preventing agent.

Third Layer: Green-Sensitive Emulsion Layer

An emulsion layer containing 0.17 g/m$^2$ (calculated as silver) of a silver chlorobromide emulsion (70 mol % silver bromide), 1.40 g/m$^2$ of gelatin, 0.40 g/m$^2$ of magenta coupler (M-11), and 0.20 g/m$^2$ of a coupler solvent*5.

Fourth Layer: Ultraviolet Absorption Layer

A layer containing 1.60 g/m$^2$ of gelatin, 0.70 g/m$^2$ of an ultraviolet absorbent*1, 0.20 g/m$^2$ of a color mixing preventing agent*4, and 0.30 g/m$^2$ of a solvent*2 for the color mixing preventing agent.

Fifth Layer: Red-Sensitive Emulsion Layer

An emulsion layer containing 0.25 g/m$^2$ (calculated as silver) of a silver chlorobromide emulsion (50 mol % silver bromide), 1.26 g/m$^2$ of gelatin, 0.50 g/m$^2$ of a cyan coupler*3, and 0.25 g/m$^2$ of a coupler solvent*2.

Sixth Layer: Ultraviolet Absorption Layer

A layer containing 1.06 g/m$^2$ of gelatin, 0.35 g/m$^2$ of an ultraviolet absorbent*1, and 0.12 g/m$^2$ of a solvent*2 for the ultraviolet absorbent.

Seventh Layer: Protective Layer

A layer containing 1.62 g/m$^2$ of gelatin.

The compounds used in the above layers are as follows.

*1: 2-(2-Hydroxy-3-sec-butyl-5-t-butylphenyl)benzotriazole

*2: Dibutyl phthalate

*3: 2-[α-(2,4-di-t-amylphenoxy)butanamido]-4,6-dichloro-5-methylphenol

*4: 2,5-Di-t-octylhydroquinone

*5: Trioctyl phosphate

*6: α-Pivaloyl-α-(2,4-dioxo-5,5-dimethyloxyzolidine-3-yl)-2-chloro-5-[α-(2,4-di-t-amylphenoxy)-butanamido]acetanilide In addition, 1-oxy-3,5-dichloro-s-triazine sodium salt was used as a gelatin hardening agent for each layer.

Each of the photosensitive papers as described above was exposed through an optical wedge and processed by the following steps.

| Processing Step | Temperature (°C.) | Time |
|---|---|---|
| Color Development | 33 | 3 min 30 sec |
| Blix | 33 | 1 min 30 sec |
| Wash | 24–34 | 3 min |
| Drying | 80 | 1 min |

The composition of each processing liquid was as follows.

| | |
|---|---|
| Color Developer | |
| Distilled Water | 800 ml |
| Additives (shown in Table 1) | |
| Triethanolamine | 11.0 ml |
| Diethylene Glycol | 0.2 ml |
| Benzyl Alcohol | 14.0 ml |
| Potassium Bromide | 0.60 g |
| Hydroxylamine Sulfate | 3.0 g |
| Potassium Sulfite | 1.8 g |
| 4-Amino-3-methyl-N—ethyl-N—[β-(methanesulfonamido)ethyl]-p-phenylenediamine.Sulfate | 4.25 g |
| Potassium Carbonate | 28.0 g |
| Calcium Ion (added as calcium nitrate) | 100 g |
| Distilled water to make | 1,000 ml |
| pH (25° C.) | 10.10 |
| Blix Solution | |
| Water | 400 ml |
| Ammonium Thiosulfate (70% soln.) | 150 ml |
| Sodium Sulfite | 18 g |
| Ethylenediaminetetraacetic Acid Iron (III) Ammonium | 55 g |
| Ethylenediaminetetraacetic Acid (2 Na) | 5 g |
| Water to make | 1,000 ml |
| pH (25° C.) | 6.70 |

Thereafter, the green light reflection density of each sample thus processed was measured and the results thus obtained are shown in Table 1.

TABLE 1

| Test No. | Additive | Addition Amount (mol/l) | Relative Sensitivity | Maximum Density |
|---|---|---|---|---|
| 1* | II-1 | $2 \times 10^{-3}$ | 90 | 2.23 |
| 2* | II-1 | $4 \times 10^{-3}$ | 95 | 2.40 |
| 3** | II-1 | $6 \times 10^{-3}$ | 100 | 2.60 |
| 4** | II-1 | $10 \times 10^{-3}$ | 100 | 2.61 |
| 5* | III-1 | $2 \times 10^{-3}$ | 89 | 2.20 |
| 6* | III-1 | $4 \times 10^{-3}$ | 94 | 2.35 |
| 7** | III-1 | $6 \times 10^{-3}$ | 100 | 2.59 |
| 8** | III-1 | $20 \times 10^{-3}$ | 100 | 2.61 |
| 9* | II-1 | $3 \times 10^{-3}$ | 100 | 2.59 |
| | III-1 | | | |
| 10* | IV-2 | $2 \times 10^{-3}$ | 88 | 2.20 |
| 11* | IV-2 | $4 \times 10^{-3}$ | 92 | 2.30 |
| 12** | IV-2 | $6 \times 10^{-3}$ | 100 | 2.59 |
| 13* | V-1 | $4 \times 10^{-3}$ | 92 | 2.33 |
| 14** | V-1 | $6 \times 10^{-3}$ | 100 | 2.60 |
| 15** | II-1 | $2 \times 10^{-3}$ | 100 | 2.60 |
| | IV-2 | $4 \times 10^{-3}$ | | |
| 16** | II-1 | $4 \times 10^{-3}$ | 100 | 2.61 |

TABLE 1-continued

| Test No. | Additive | Addition Amount (mol/l) | Relative Sensitivity | Maximum Density |
|---|---|---|---|---|
| | IV-2 | $8 \times 10^{-3}$ | | |

*Comparison test

**Test of this invention

As is clear from the results shown in Table 1, by developing using the color developer containing the additive or the additives in an amount larger than $5.0 \times 10^{-3}$ mol/liter according to this invention, the sensitivity and the coloring density could be remarkably improved.

EXAMPLE 2

By following the same procedure as Test No. 7 in Example 1 using Magenta Coupler M-4, M-10, M-16, M-20, M-29, M-34, or M-37 in place of Magenta Coupler M-1 in the color photographic material, approximately same high sensitivity and high coloring density as in Example 1 were obtained.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide color photosensitive material which comprises processing a silver halide color photosensitive material containing at least one 4-mercapto-5-pyrazolone type magenta coupler represented by formula (I)

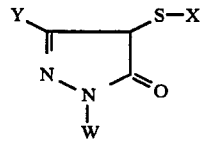

(I)

wherein W represents an aryl group; X represents an alkyl group, an aryl group or a heterocyclic ring group; and Y represents an acylamino group, a ureido group, or an anilino group; with a color developer containing at least one compound selected from a compound represented by formula (II)

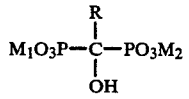

(II)

wherein R represents a lower alkyl group; and $M_1$ and $M_2$, which can be the same or different, each represents a hydrogen atom, an alkali metal atom, or an ammonium group; a compound represented by formula (III)

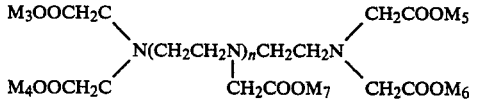

(III)

wherein $M_3$, $M_4$, $M_5$, $M_6$ and $M_7$, which can be the same or different, each represents a hydrogen atom, an alkali metal atom, or an ammonium group, and n represents an integer of 1 or 2; an aminopolyphosphonic acid, and a phosphonocarboxylic acid in a concentration greater than $5.0\times10^{-3}$ mol/liter.

2. A method as in claim 1, wherein said at least one compound selected from a compound represented by formula (II), a compound represented by formula (III), an aminopolyphosphonic acid, and a phosphonocarboxylic acid is present in a concentration of from $6.0\times10^{-3}$ to $30\times10^{-3}$ mol/liter.

3. A method as in claim 1, wherein said 4-mercapto-5-pyrazolone type magenta coupler is represented by formulae (IV) or (V)

(IV)

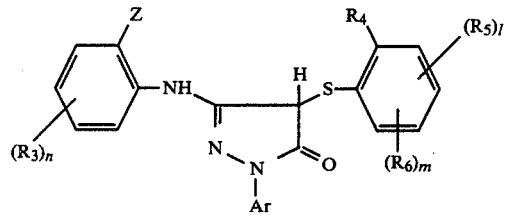

(V)

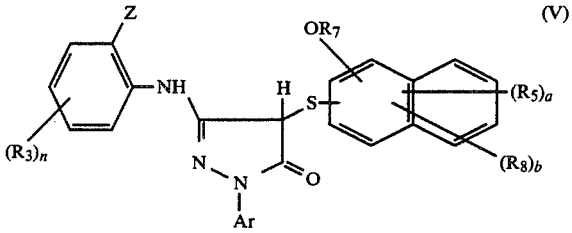

wherein Ar represents a phenyl group substituted by at least one halogen atom, alkyl group, alkoxy group, alkoxycarbonyl group, or cyano group; Z represents a halogen atom or an alkoxy group; $R_3$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, a ureido group, an acyl group, a nitro group, or a carboxy group; $R_4$ represents a halogen atom, a hydroxy group, an amino group, an alkyl group, an alkoxy group, an aryloxy group, or an aryl group; $R_5$ represents a hydrogen atom, an amino group, an acylamino group, a ureido group, an alkoxycarbonylamino group, an imido group, a sulfonamido group, a sulfamoylamino group, a nitro group, an alkoxycarbonyl group, a carbamoyl group, an acyl group, a cyano group, or an alkylthio group; $R_6$ represents a hydrogen atom, a halogen atom, a hydroxy group, an alkyl group, an alkoxy group, or an aryl group; at least one of said $R_4$ and $R_6$ representing an alkoxy group; $R_7$ represents an alkyl group or an aryl group; $R_8$ represents a hydrogen atom, a halogen atom, an alkyl group, an alkoxy group, an aryloxy group or an aryl group; a and b each represents an integer of 1 to 5; m represents an integer of 1 to 3; n represents an integer of 1 to 4; and l represents an integer of 1 to 3.

4. A method as in claim 3, wherein said at least one compound selected from a compound represented by formula (II), a compound represented by formula (III), an aminopolyphosphonic acid, and a phosphonocarboxylic acid is present in a concentration of from $6.0\times10^{-3}$ to $30\times10^{-3}$ mol/liter.

5. A method as in claim 1, wherein the compound represented by formula (II) is

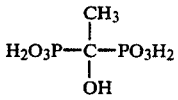

(II-1)

the compound represented by formula (III) is

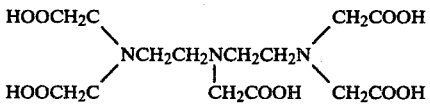

(III-1)

the aminopolyphosphonic acid is

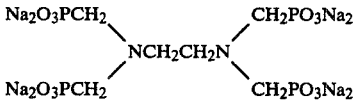

(IV-2)

and the phosphonocarboxylic acid is

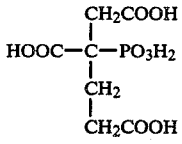

(V-1)

6. A method as in claim 2, wherein the compound represented by formula (II) is

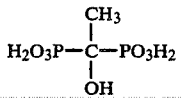

(II-1)

the compound represented by formula (III) is

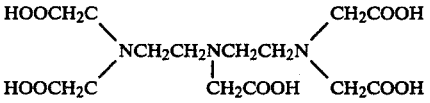

(III-1)

the aminopolyphosphonic acid is

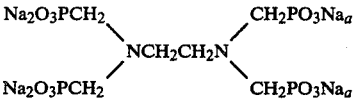

(IV-2)

and the phosphonocarboxylic acid is

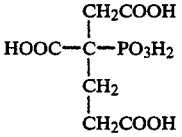

(V-1)

7. A method as in claim 4, wherein the compound represented by formula (II) is

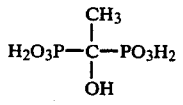
(II-1)
the compound represented by formula (III) is
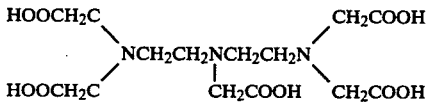
(III-1)
the aminopolyphosphonic acid is
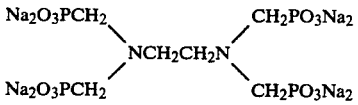
(IV-2)
and the phosphonocarboxylic acid is
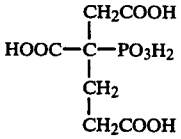
(V-1)
* * * * *